United States Patent [19]

Kay et al.

[11] 4,125,974

[45] Nov. 21, 1978

[54] CONTROL SYSTEM FOR TELESCOPIC BOOM

[75] Inventors: Christopher G. Kay; Robert A. Fritsch, both of Cedar Rapids, Iowa

[73] Assignee: Harnischfeger Corporation, W. Milwaukee, Wis.

[21] Appl. No.: 813,798

[22] Filed: Jul. 8, 1977

[51] Int. Cl.[2] ..... E02F 3/00; F15B 11/20

[52] U.S. Cl. ..... 52/115; 91/530; 212/55

[58] Field of Search ..... 52/115; 212/55; 137/596.13; 92/53; 91/411 R

[56] References Cited

U.S. PATENT DOCUMENTS

| | | | |
|---|---|---|---|
| 3,721,054 | 3/1973 | Hornagold | 52/115 |
| 3,777,629 | 12/1973 | Johnston | 212/55 |
| 3,807,108 | 4/1974 | Johnston | 212/55 |
| 3,809,248 | 5/1974 | Ohniwa | 52/115 |
| 3,976,098 | 8/1976 | Raymond | 137/596.13 |

*Primary Examiner*—John E. Murtagh

*Attorney, Agent, or Firm*—James E. Nilles

[57] ABSTRACT

An electro-hydraulic control system to enable either simultaneous extension or retraction of all boom sections in a telescopic crane boom or independent extension or retraction of one or more individual boom sections comprises a valve assembly, including solenoid-operated extend and retract valves, on each boom section cylinder; a manually operable three-position (neutral, extend, retract) main control valve for connecting the valve assemblies to a pressurized fluid source and to a reservoir; a relay for energizing all solenoid valves simultaneously when the main control valve is operated to extend or retract positions to thereby effect simultaneous extension or retraction, respectively, of all boom sections; and manually actuatable selector switches, one for each movable boom section, which, when any one selector switch is actuated while the main valve is operated, override the relay and energize only the solenoid valves in a selected valve assembly thereby enabling independent extension or retraction of a selected boom section.

9 Claims, 13 Drawing Figures

CONTROL SYSTEM FOR TELESCOPIC BOOM

BACKGROUND OF THE INVENTION

1. Field of Use

This invention relates generally to an electro-hydraulic control system for a multi-section hydraulically operated telescopic crane boom. In particular, it relates to such a control system which enables either simultaneous extension or retraction of all movable boom sections or independent extension or retraction of one or more selected movable boom sections.

2. Description of the Prior Art

The prior art contains many examples of telescopic crane booms and control systems for the hydraulic cylinders thereof whereby the movable boom sections can be extended or retracted. In some cases, the control system employed a separate independently operable hydraulic control valve for the hydraulic cylinder of each movable boom section. However, although the boom sections could be moved simultaneously or independently, separate fluid supply and return hoses were required for each control valve and its associated cylinder. This resulted in costly redundancy of valves, hoses, and other components and also created problems and expense in regard to the disposition, arrangement, operation, and servicing of many such hoses located within and between boom sections. In other cases, the control system employed a single control valve and a flow divider for feeding hydraulic control fluid to each boom cylinder. In such cases, only simultaneous movement of all boom sections was possible and "random telescoping" tended to result. This caused unequal stressing and loading of the various boom sections, which is an unacceptable and unsafe condition in some load-handling situations. The following U.S. patents are but a few examples of prior art telescopic boom control systems: 3,976,097; 3,666,125; 3,672,159; 3,624,979.

SUMMARY OF THE PRESENT INVENTION

In accordance with the present invention, there is provided an electro-hydraulic control system to enable either simultaneous extension or retraction of all boom sections in a telescopic crane boom or independent extension or retraction of one or more individual boom sections. The control system comprises a valve assembly, including a normally closed solenoid-operated extend valve, a normally closed solenoid-operated retract valve, and a combined thermal relief and holding valve on each boom section cylinder. The control system also comprises a manually operable three-position (neutral, extend, retract) main control valve for connecting the valve assemblies to a pressurized fluid source, such as a pump, and to a reservoir. The control system further comprises a relay for energizing all solenoid valves simultaneously when the main valve is operated to thereby effect simultaneous extension or retraction of all boom sections. The control system also comprises manually operable selector switches, one for each movable boom section, which, when any one selector switch is actuated while the main valve is actuated, override the relay and energize only the extend and retract solenoid valves in a selected valve assembly thereby enabling independent extension or retraction of a selected boom section cylinder and its associated boom section.

The telescopic crane boom has a base section and first, second, and third, etc., telescopically movable boom sections; and first, second, and third extendable and retractable hydraulic boom section cylinders for moving the respective boom sections. Each boom section cylinder comprises a cylinder housing having a relatively movable piston therein which is connected to a piston rod and divides the housing into an extend chamber (ahead of the piston) and a retract chamber (behind the piston). Each piston and piston rod is provided with first (extend) and second (retract) fluid passages therethrough communicating with the extend and retract chambers, respectively, of the cylinder housing. The control valve assembly for each cylinder is mounted on the outer end of the piston rod. The retract chamber of the first cylinder is connected by its second (retract) passage to the main control valve for connection thereby either to the pump or to the reservoir. The retract chamber of the first cylinder has a port in the cylinder housing which is connected by a flexible fluid line or hose and through the second (retract) passage to the retract chamber of the second cylinder. The retract chamber of the second cylinder has a port in the cylinder housing which is connected by a flexible fluid line or hose and the second (retract) passage to the retract chamber of the third cylinder. The extend valves of the control valve assemblies are connected to the main control valve for connection thereby either to the pump or to the reservoir.

The main control valve has a manually operable control lever movable between neutral, extend, and retract positions to effect corresponding operation of the main control valve. The control lever also operates a normally open on-off relay control switch for a relay which, when energized, effects simultaneous energization of both the extend solenoid valve and the retract solenoid valve in all three valve assemblies. The control means also comprises a plurality of manually operable selector switches, one for each control valve assembly. Actuation of a selector switch causes energization of both the extend solenoid valve and the retract solenoid valve in its respective valve assembly and also overrides or prevents energization of the relay in response to operation of the control lever.

When the control lever is in neutral and no selector switch is actuated, the main control valve is closed, all solenoid-operated valves are de-energized and closed, and all cylinders and boom sections are at rest. When the control lever is moved to either its extend or retract position and no selector switch is actuated, the main control valve operates to supply fluid (and a reservoir connection) for all valve assemblies, the relay control switch closes to energize the relay and thereby energize and open all solenoid valves, and all cylinders and boom sections extend or retract simultaneously, depending on control lever position, as fluid flows to the extend or retract chambers. When the control lever is moved to either its extend or retract position and a desired selector switch is actuated, the main control valve operates to supply fluid (and a reservoir connection) for all valve assemblies, but the relay does not energize and, consequently, only the solenoid valves in the selected valve assembly operate to allow fluid flow to the cylinder thereof for extend or retract operation of its associated boom section.

A crane boom in accordance with the invention offers many advantages over prior art arrangements. For example, all boom sections can be moved together or individually to suit particular job conditions. Furthermore, the control system, by connecting the retract chambers of the cylinders in series by means of flexible hoses within the boom, eliminates the need for a separate relatively long fluid return hose between each cylinder and the main control valve, as is the case in some prior art arrangements. As a result, more space is available for other components between the relatively movable boom sections and less hose is exposed to wear and tear as it is wound and unwound within the boom as the boom extends and retracts. The control system in accordance with the invention also eliminates the need for a separate control handle and associated valve for each movable boom section. Instead, a single main valve and a single control lever therefor are employed, in conjunction with the solenoid valves and the push-button selector switches, to control the boom sections. This eliminates many costly components and further reduces the chance of breakdown and need for upkeep. Since the control system in accordance with the invention uses solenoid-operated valves which are located directly on the cylinders (i.e., on the exposed ends of the piston rods), relatively small and highly flexible electrical wires can be employed within the boom and beteeen the boom sections in place of bulky and costly hoses used as the fluid return lines in some prior art arrangements. By employing fluid passages which extend through the piston rod to afford communication between the extend and retract chambers and by interconnecting the retract chambers in certain of the cylinders, several fluid lines, hydraulic hoses, and associated connectors are eliminated thereby reducing cost and increasing reliability. Other objects and advantages of the invention will hereinafter appear.

DESCRIPTION OF A PREFERRED EMBODIMENT

Figure 1:
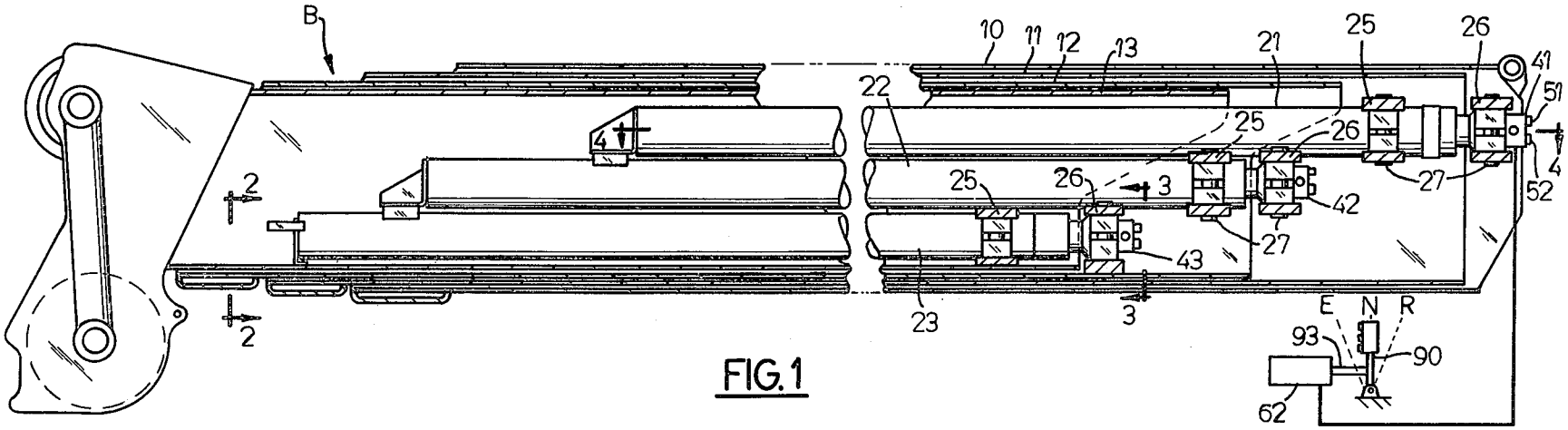
FIG. 1 is a side elevational view, with portions broken away, of a telescopic crane boom in accordance with the invention and showing the hydraulic cylinder for extending and retracting the boom sections.
Figure 3:
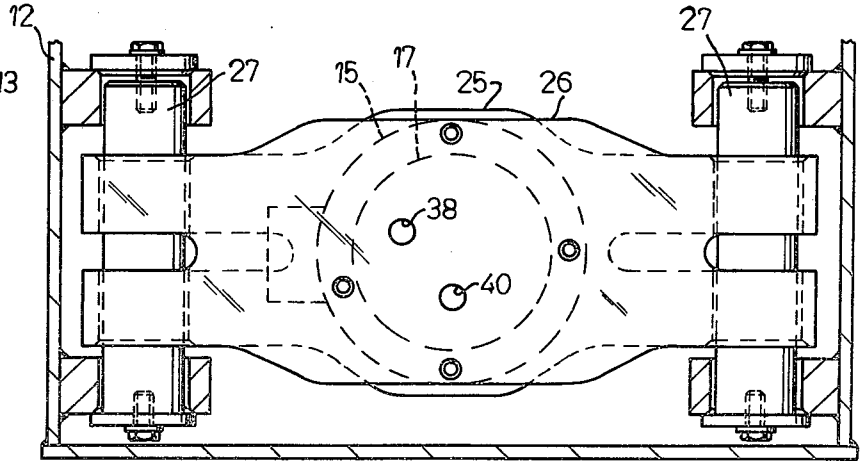
FIG. 3 is a cross-section view taken on line 3—3 of FIG. 1.
Figure 2:
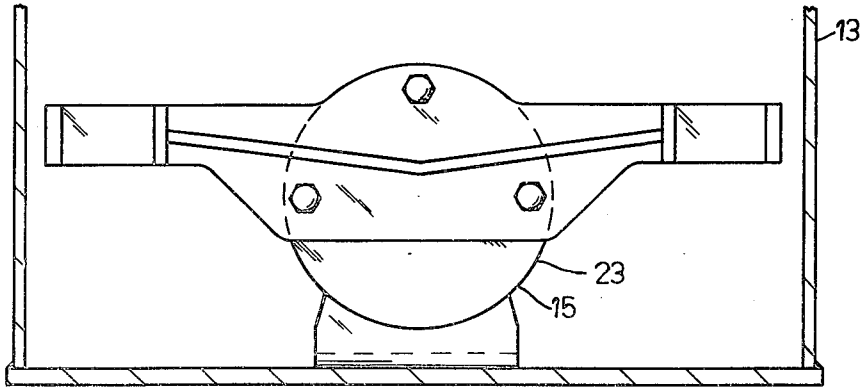
FIG. 2 is a cross-section view taken on line 2—2 of FIG. 1.
Figure 6:
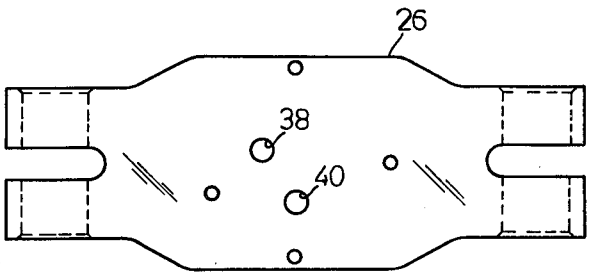
FIG. 6 is an elevational view taken on line 6—6 of FIG. 4.
Figure 5:
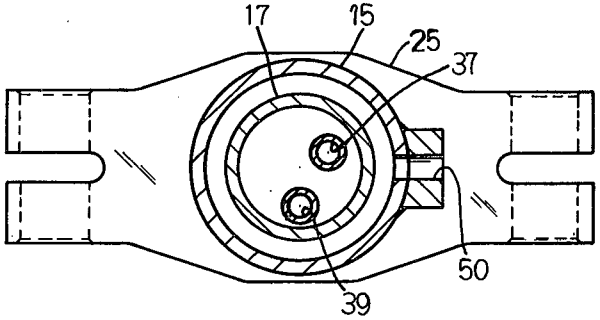
FIG. 5 is a cross-section view taken generally on line 5—5 of FIG. 4.
Figure 10:
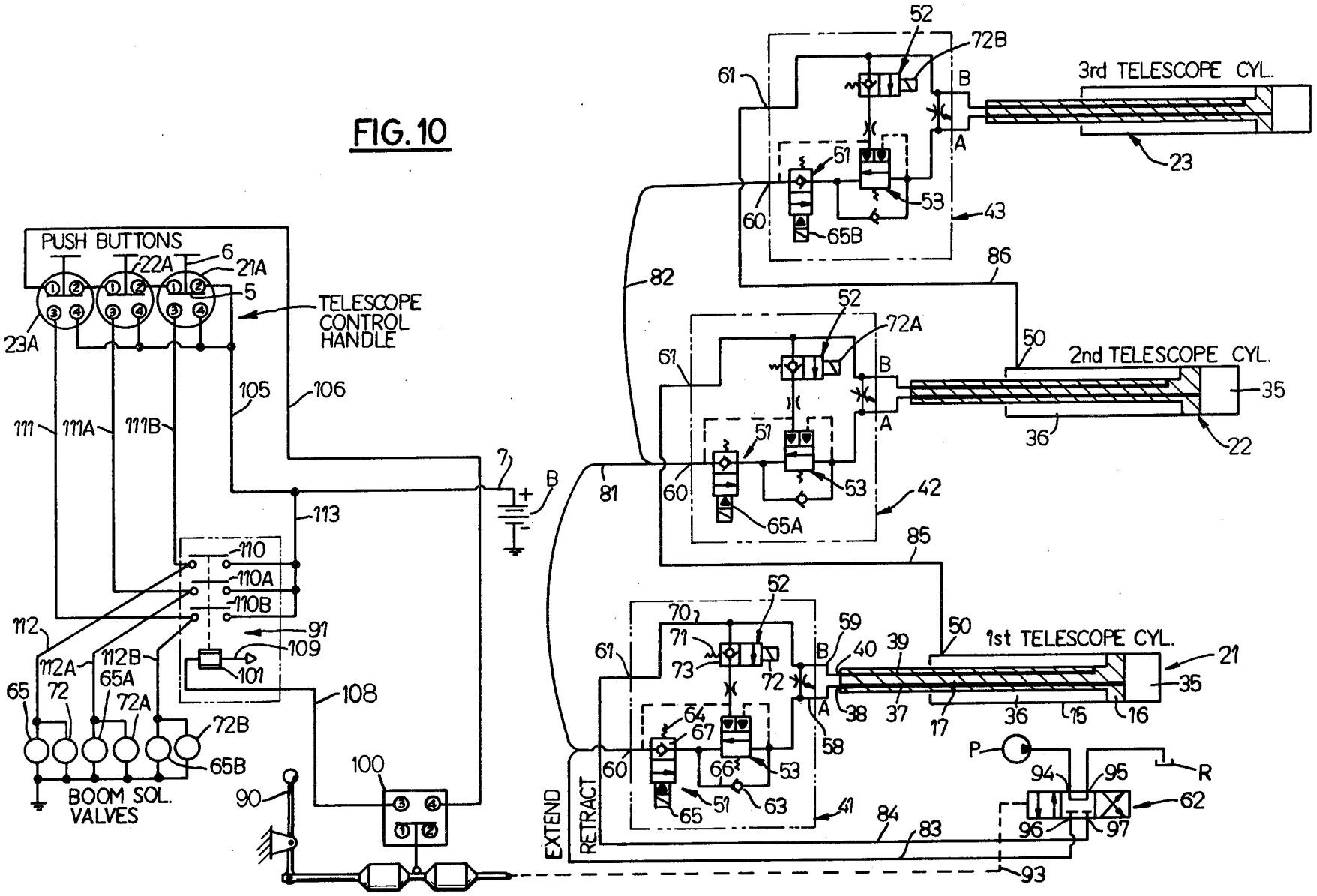
FIG. 10 is a schematic diagram of the electro-hydraulic control system of the telescopic crane boom of FIG. 1.

Referring to FIGS. 1 and 10, in accordance with the present invention, there is provided an electro-hydraulic control system to enable either simultaneous extension or retraction of all boom sections 11, 12, 13 in a telescopic crane boom B or independent extension or retraction of one or more individual boom sections 11, 12, 13. The control system comprises valve assemblies 41, 42, 43 on the boom section cylinders 21, 22, 23, respectively, each valve assembly including a normally closed solenoid-operated extend valve 51, a normally closed solenoid-operated retract valve 52, and a combined thermal relief and holding valve 53. The control system also comprises a manually operable three-position (neutral, extend, retract) main control valve 62 for connecting the valve assemblies 41, 42, 43 to a pressurized fluid source, such as a pump P, and to a reservoir R. The control system further comprises a relay 91 for energizing all solenoid valves 51 and 52 simultaneously when the main valve 62 is operated to thereby effect simultaneous extension or retraction of all boom sections 11, 12, 13. The control system also comprises manually operable selector switches 21A, 22A, 23A, one for each movable boom section 21, 22, 23, respectively, which, when any one selector switch is actuated while the main valve 62 is actuated, override the relay 91 and energize only the extend and retract solenoid valves 51 and 52 in a selected valve assembly 41, 42, or 43 thereby enabling independent extension or retraction of a selected boom section cylinder 21, 22, or 23 and its associated boom section 11, 12, or 13. Any one boom section 11, 12, 13, alone, or any combination of boom sections, can be moved by means of the selector switches.

Figure 4:
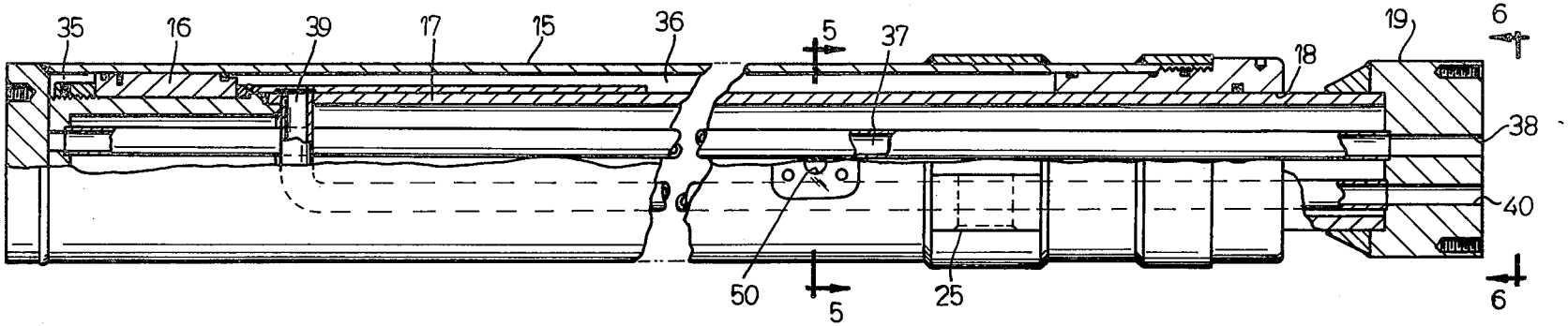
FIG. 4 is an enlarged cross-section view of one of the hydraulic cylinders taken on line 4—4 of FIG. 1.
Figure 7:
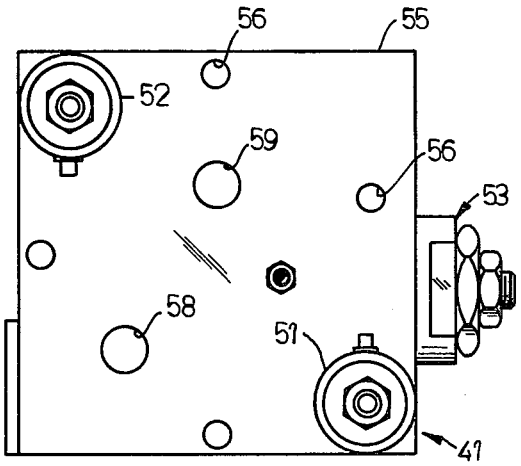
FIG. 7 is an enlarged end elevational view of the control valve assembly for the hydraulic cylinder shown in FIG. 4.
Figure 8:
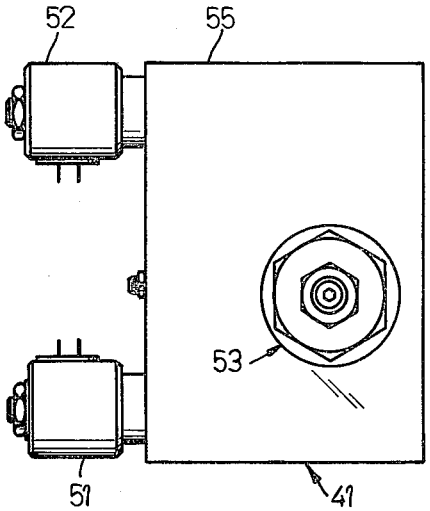
FIG. 8 is a side elevational view of the control valve assembly of FIG. 7.
Figure 9:
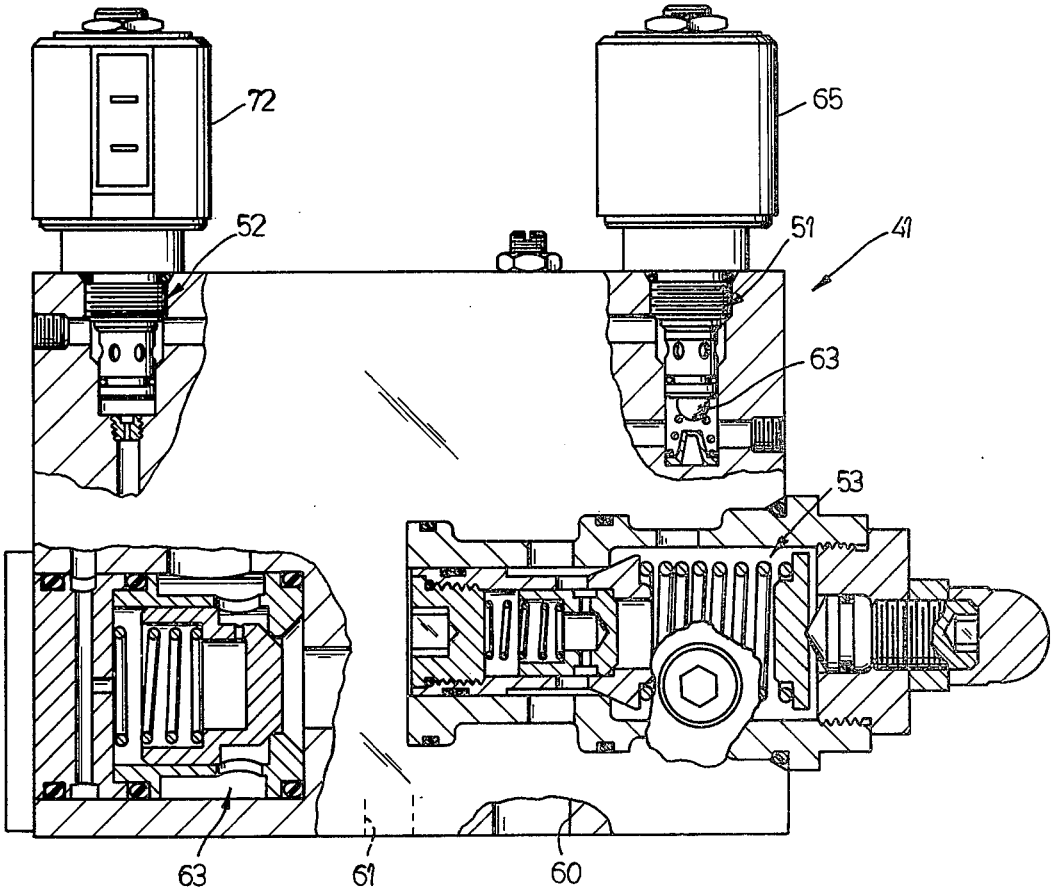
FIG. 9 is an enlarged bottom elevational view, with portions broken away, of the control valve assembly of FIGS. 7 and 8.

The telescopic crane boom B has a base section 10, and the first section 11, the second section 12, and the third section 13 are telescopically movable with respect thereto and to each other. First, second, and third extendable and retractable hydraulic boom section cylinders 21, 22, and 23, respectively, are provided for moving the movable boom sections 11, 12, and 13, respectively. As FIGS. 4 and 10 show, each boom section cylinder 21, 22, 23 comprises a cylinder housing 15 having a relatively movable piston 16 therein which is connected to a piston rod 17 and divides the housing 15 into an extend chamber 35 (ahead of the piston) and a retract chamber 36 (behind the piston). Each piston 16 and piston rod 17 is provided with first (extend) fluid passage 37 and second (retract) fluid passage 38 therethrough communicating with the extend and retract chambers 35 and 36, respectively, of the cylinder housing 15. The control valve assemblies 41, 42, 43 for the cylinders 21, 22, 23, respectively, are each mounted on the outer end of the associated piston rod 17. As FIG. 10 shows, the retract chamber 36 of the first cylinder 21 is connected by its second (retract) passage 39 to the main control valve 62 for connection thereby either to the pump P or to the reservoir R. The retract chamber 36 of the first cylinder 21 has a port 50 in the cylinder housing 15 which is connected by a flexible fluid line or hose 85 and through the second (retract) passage 39 to the retract chamber 36 of the second cylinder 22. The retract chamber 36 of the second cylinder 22 has a port 50 in the cylinder housing 15 which is connected by a flexible fluid line or hose 86 and the second (retract) passage 39 to the retract chamber 36 of the third cylinder 23. The extend valves 51 of the control valve assemblies 41, 42, 43 are connected to the main control valve 62 for connection thereby either to the pump P or to the reservoir R.

As FIG. 10 shows, the main control valve 62 has a manually operable control lever 90 movable between neutral, extend, and retract positions to effect corresponding operation of the main control valve 62. The control lever 90 also operates a normally open on-off relay control switch 100 for a relay 91 which, when energized, effects simultaneous energization of both the extend solenoid valve 51 and the retract solenoid valve 52 in all three valve assemblies 41, 42, 43. The control means also comprises a plurality of manually operable selector switches 21A, 22A, 23A, one for each control valve assembly 41, 42, 43, respectively. Actuation of a selector switch 21A, 22A, 23A causes energization of both the extend solenoid valve 51 and the retract solenoid valve 52 in its respective valve assembly 41, 42, 43 and also overrides or prevents energization of the relay 91 in response to operation of the control lever 90.

When the control lever 90 is in neutral and no selector switch 21A, 22A, 23A is actuated, the main control valve 62 is closed, all solenoid-operated valves 51, 52 are de-energized and closed, and all cylinders 21, 22, 23 and boom sections 11, 12 13 are at rest. When the control lever 90 is moved to either its extend or retract position and no selector switch 21A, 22A, 23A is actuated, the main control valve 62 operates to supply fluid (and a reservoir connection) for all valve assemblies 41, 42, 43, the relay control switch 100 closes to energize the relay 91 and thereby energize and open all solenoid valves 51 and 52, and all cylinders 21, 22, 23 and boom sections 11, 12, 13 extend or retract simultaneously, depending on control lever position, as fluid flows to the extend chamber 35 or the retract chamber 36 thereof. When the control lever 90 is moved to either its extend or retract position and a desired selector switch 21A, 22A, or 23A is actuated, the main control valve 62 operates to supply fluid (and a reservoir connection) for all valve assemblies 41, 42, 43, but the relay 91 does not energize and, consequently, only the solenoid valves 51, 52 in the selected valve assembly 41, 42, or 43 operates to allow fluid flow to the cylinder thereof for extend or retract operation of its associated boom section.

As FIGS. 1, 4, and 10 best show, the piston rod 17 of each cylinder 21, 22, 23 is slideable in an opening 18 through the base end of the cylinder housing 15. The outwardly extending end of the piston rod 17 has a valve mounting plate 19 rigidly secured thereto. The cylinder housing 15 and the plate 19 are provided with a housing mounting bracket 25 and a piston rod mounting bracket 26, respectively, each having a mounting pin 27 therein. The cylinders 21, 22, and 23 are connected, respectively, between the base section 10 and the first boom section 11, between the first boom section 11 and the second boom section 12, and between the second boom section 12 and the third boom section 13. More specifically, the piston rod mounting brackets 26 on the cylinders 21, 22, and 23 are connected to the boom base section 10, to the first section 11, and to the second section 12 by their pins 27. The cylinder housing mounting brackets 25 of the cylinders 21, 22, and 23 are connected to the first boom section, the second boom section 12, and the third boom section 13, respectively, by their pins 27.

As hereinbefore explained, the piston 16 in each cylinder 21, 22, 23 divides the cylinder housing 16 into an extend chamber 35 (ahead of the piston) and a retract chamber 36 (behind the piston). A first fluid passage 37 extends through the plate 19, piston rod 17, and piston 16 in each cylinder 21, 22, 23 and communications between a fluid extend port 38 in the plate 19 and the extend chamber 35. A second fluid passage 39 extends through the plate 19 and the piston rod 17 in each cylinder 21, 22, 23 and communicates between a retract port 40 in plate 19 and the retract chamber 36. The ports 38 and 40 of each cylinder 21, 22, 23 are connected to the valve assemblies 41, 42, 43 as hereinafter explained. The housings 15 of the cylinders 21 and 22 only are provided with a retract port 50.

As FIGS. 1, 7, 8, 9 and 10 show, the cylinders 21, 22, 23 are provided with the control valve assemblies 41, 42, 43, respectively, which are mounted on the valve mounting face plate 19 of the cylinder. Each control valve assembly 41, 42, 43 includes a solenoid-operated normally closed extend valve 51, a solenoid-operated normally closed retract valve 52, and a combined thermal relief and holding valve 53. Since the valve assemblies 41, 42, 43 are identical in construction, only valve assembly 41 is hereinafter described in detail.

Valve assembly 41 comprises a housing 55 having mounting holes 56 for securing it to plate 19 of its associated piston rod 17 as by bolts 54. Housing 55 has a first pair of extend and retract ports 58 and 59, respectively, connected to the extend and retract ports 38 and 40, respectively, in plate 19. Housing 55 also has a second pair of extend and retract ports 60 and 61 for connection, through main valve 62 shown in FIGS. 9 and 10, to the source of pressurized hydraulic fluid such as pump P and to reservoir R.

The solenoid-operated extend valve 51 is located in series with a check valve 63 in a circuit 66 between the extend ports 60 and 58 and takes the form of a two-position (open-close) valve which is normally biased to closed position by a biasing spring 64 and is opened by energization of its solenoid 65. Valve 51 includes a normally closed ball-type check valve 67 which opens to allow fluid back-flow therethrough if the thermal relief valve 53 is operated. Check valve 63 opens when solenoid-operated extend valve 51 is opened and allows pressurized fluid flow from pump P through extend ports 60 and 58 into extend chamber 35 of the cylinder.

The solenoid-operated retract valve 52 is connected to a circuit 70 between the retract ports 61 and 59 and takes the form of a two-position (open-close) valve which is normally biased to closed position by a biasing spring 71 and is opened by energization of its solenoid 72. Valve 52 includes a normally closed ball-type check valve 73 which opens to allow fluid back-flow therethrough if fluid pressure at extend port 60 exceeds a predetermined value.

Figure 11:
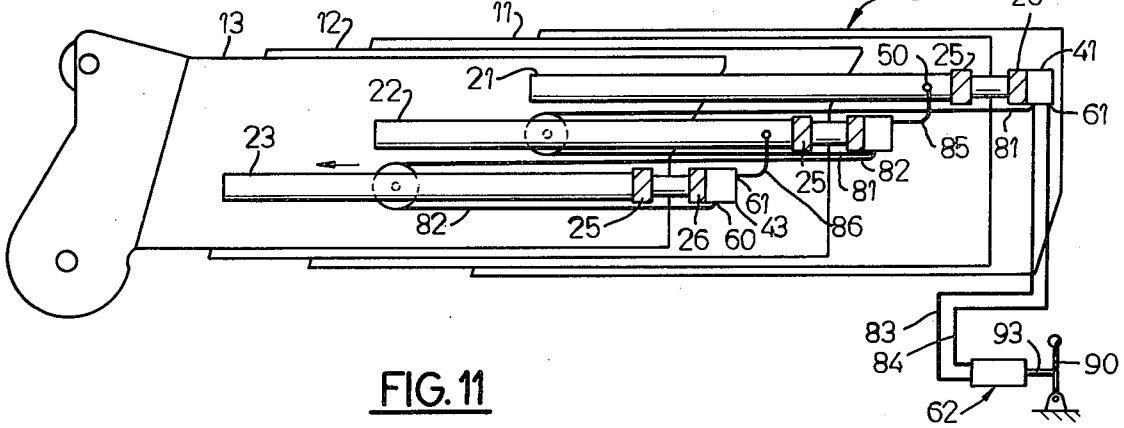
FIG. 11 is a schematic view similar to FIG. 1 and showing the boom in retracted condition.
Figure 12:
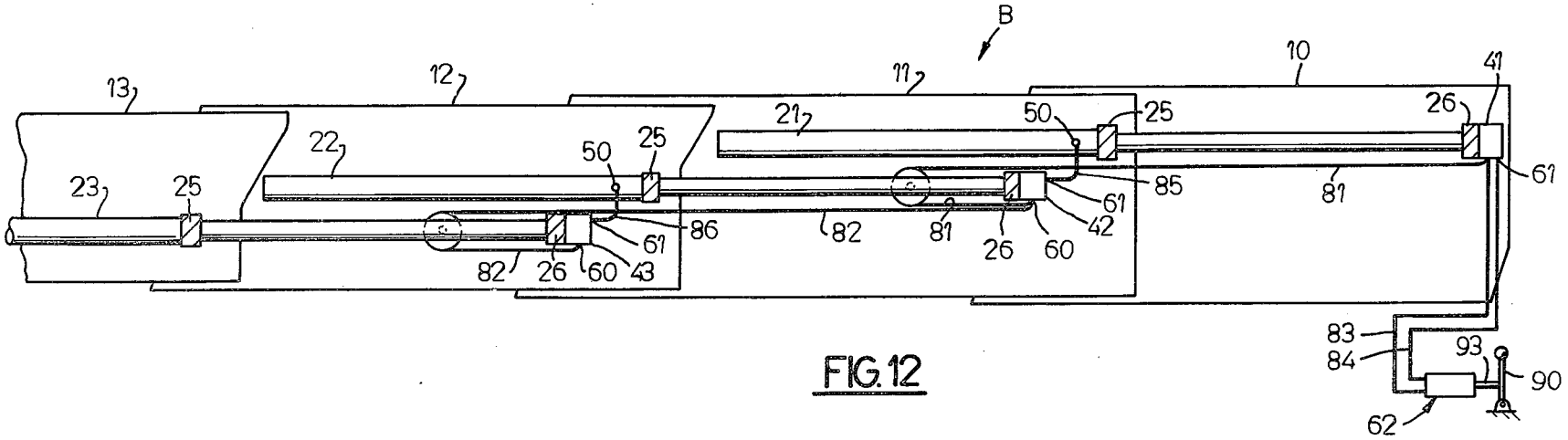
FIG. 12 is a schematic view similar to FIG. 11 and showing the boom in extended condition.

As FIGS. 1, 11, and 12 show, the extend ports 60 of the valve assemblies 41, 42, and 43 are connected in parallel with each other by means of fluid lines or hoses 81 and 82 and are connected to main valve 62 by a supply hose 83. The retract port 61 of valve assembly 41 on cylinder 21 is connected by means of a fluid line or hose 84 to main valve 62. The retract chamber 36 of the first cylinder 21 has its port 50 connected to the retract port 61 of valve assembly 42 on the second cylinder 22 by a hose 85. The retract chamber 36 of the second cylinder 22 has its port 50 connected to the retract port 61 of valve assembly 43 on the third cylinder 23 by a hose 86. The retract chamber 36 of the first cylinder 21 is connected by the second passage 39 in the piston rod 17 of the first cylinder 21 directly to the normally closed three-position main valve 62 for connection thereby either to the source of pressurized fluid P or to the fluid reservoir R. The extend valves 51 of the control valve assemblies 41, 42, 43 are also connectable either to the source of pressurized fluid P or to the fluid reservoir R through the main valve 62 which has the manually operable control lever 90 which is movable from neutral to either extend or retract positions to effect corresponding operation of the main valve 62.

As FIGS. 10, 11, and 12 show, the main valve 62 is a conventional three-position (neutral, extend, and retract) valve which is manually operable by means of the control lever 90 which is connected thereto by a suitable linkage 93. Valve 62 has a fluid supply port 94 connected to the pressure port of pump P and also has a fluid return port 95 which is connected to reservoir R. The main valve 62 is also provided with ports 96 and 97 which are connected by the extend and retract lines 83 and 84, respectively, to the valve assemblies 41, 42, and 43. When lever 90 is in neutral position, main valve 62 is also in neutral position and the pump P is connected directly to the reservoir R. In this condition, no fluid is supplied to the extend and retract lines 83 and 84, respectively. When control lever 90 is moved to the extend position, fluid is supplied from pump P through ports 94 and 96 of main valve 62, through extend line 83, and to the extend valves 51 of the valve assemblies 41, 42, and 43, respectively. In this condition, the retract line 84 is connected through the ports 97 and 95 to the reservoir R enabling fluid to flow from each of the retract chambers 36 of the cylinders 23, 22, and 21 to the reservoir.

As FIG. 10 shows, the extend solenoid valves 51 of each of the valve assemblies 41, 42, and 43 are provided with electrically operated solenoids designated 65 65A, and 65B, respectively. The retract valves 52 of the valve assemblies 41, 42 and 43 are provided with electrically operated solenoids designated 72, 72A, and 72B, respectively. The extend solenoid 65 and the retract solenoid 72 are connected in parallel with each other. The extend solenoid 65A and the retract solenoid 72A are connected in parallel with each other. The extend solenoid 65B and the retract solenoid 72B are connected in parallel with each other. When these solenoids are de-energized, their associated valves assume the closed position shown in FIG. 10. When any of the solenoids are energized, their associated valves assume the hereinbefore-described open position.

The control lever 90, in addition to being connected to operate main valve 62, is connected to operate a relay control switch 100. Control switch 100 is a single pole, single throw normally open switch which assumes the open position when the control lever 90 is in neutral and which closes when the control lever 90 is moved to either the extend or retract position. Switch 100 is connected in series circuit with a relay coil 101 and with the push-button switches 21A, 22A, and 23A across a source of electrical power indicated by a battery B. Each push-button switch 21A, 22A, 23A is a double pole switch which is normally biased into a position wherein its contacts 1 and 2 are connected to each other by a movable contact 5. Contact 5 is movable by means of a spring biased push-button 6 out of the position wherein it connects contacts 1 and 2 into another position wherein it makes contact with and connects the switch contacts 3 and 4. FIG. 10 shows the push-button switches 21A, 22A, and 23A each in the condition wherein its push-button 6 is not depressed and its contacts 1 and 2 are connected by contact 5. Thus, an electric circuit exists from positive contact 7 of battery B through a conductor 105, through the contacts 1 and 2 of each switch 21A, 22A, 23A, through a conductor 106 to the switch contact 4 in switch 100. Switch contact 3 of switch 100 is connected by a conductor 108 to one side of relay coil 101 of relay 91 and the other side of the relay coil is connected by conductor 109 to ground.

Relay coil 101 is energizable to effect closing of the three normally open relay contacts 110, 110A, and 110B. One terminal of each of the relay contacts 110, 110A, 110B is connected by the conductors 111, 111A, and 111B to the contact 3 of the push-button switches 23A, 22A, 21A, respectively. The said one terminals of the contacts 110, 110A, 110B are connected by conductors 112, 112A, and 112B to one side of the solenoid coils 65, 65A, 65B, respectively, and to one side of the solenoid coils 72, 72A, 72B, respectively. The other side of all of the relay coils are connected to ground.

In operation, movement of control lever 90 from neutral to either the extend or retract position while each of the push-buttons 21A, 22A, 23A are not actuated and are in the position shown in FIG. 10, results in energization of relay coil 101, closure of the relay contacts 110, 110A, 110B, thereby connecting all of the solenoid valves 65, 72, 65A, 72A, 65B, 72B, through the relay contacts, through a conductor 113 to terminal 7 of battery B. Thus, actuation of control lever 90 from neutral alone effects operation of relay 91 and energization of all six solenoid coils for the solenoid valves 51 and 52.

Depression of any of the push-button switches 21A, 22A, 23A from the position shown in FIG. 10 to its actuated position, interrupts the series circuit in which relay control switch 100 and relay coil 101 are connected. Consequently, with any one of the push-button switches actuated, movement of control lever 90 from neutral to either extend or retract position will not result in energization of relay 91. Actuation of any one of the push-button switches 21A or 22A or 23A will result in energization of the solenoid coils 65, 72 or 65A, 72A, or 65B, 72B.

Figure 13:
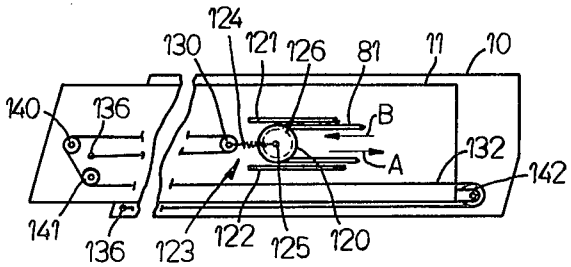
FIG. 13 is a schematic view of a means for guiding flexible hoses located within the boom.

As FIGS. 10, 11, 12, and 13 show, the hoses 81 and 82 are located within boom B and means are provided for mounting the hoses therewithin so that they can be coiled and uncoiled as the boom sections 11, 12, and 13 are retracted and extended. As FIG. 13 shows in connection with hose 81 for cylinder 22 mounted between boom sections 10 and 11, for example, there is provided a pulley 120 around which hose 81 is disposed and the pulley runs between upper and lower guide rails 121 and 122, respectively. Pulley 120 moves in the direction of arrow A during an extend movement and in the direction of arrow B during a retract movement. Pulley 120 is supported on and moved by a pulley mount 123 which includes a yoke 124 connected to the axle 125 of the pulley 120. The pulley mount 123 also includes biasing spring means 126 which connect the yoke 124 to another yoke 128 which is connected to the other end of spring 126 and which carries a small pulley 130. A flexible wire cable 132 has one of its ends anchored as at point 134 on the forward end of boom base section 10. The other end of cable 132 is anchored as at point 136 at a point near the forward end of first boom section 11. The cable 132 extends around the cable pulley 130 and around three other cable pulleys designated 140, 141, and 142. Cable pulley 140 is mounted for rotation on boom section 11 near the forward end thereof, and cable pulley 141 is mounted on boom section 11 below cable pulley 140. The cable pulley 142 is mounted for rotation on boom 11 near the lower rear end thereof. Thus, as boom section 11 is extended outwardly from base section 10, the hose pulley 120 is able to move in the direction of arrow A in FIG. 13 closer to the rear end of boom section 11, as comparison of FIGS. 11 and 12 show, so that hose 81 is able to adjust to the extension of boom section 11. The aforedescribed arrangement maintains the hose 81 in a taut condition clear of interference of any components within the boom. It is to be understood that an arrangement similar to that shown in FIG. 13 is provided for the hose 82. As FIGS. 11 and 12 show, the hoses 85 and 86 are of relatively short fixed length and do not need to be coiled and uncoiled as the boom sections are telescoped because the ends of each of the hoses 85 and 86 are always in the same relative position with respect to each other. The electrical conductors for the solenoids on the valve assemblies 42 and 43 are secured to and movable with the hose loops 81 and 82.

OPERATION

The telescopic crane boom B is operated as follows by the electrohydraulic control system shown in FIG. 10. Assume initially that all three boom sections 11, 12, 13 and the operating cylinders 21, 22, and 23 are in the fully retracted position as shown in FIG. 1. Further assume that control lever 90 and main control valve 62 are in neutral and that none of the push-buttons 21A, 22A, 23A are depressed. In this condition, all of the extend valves 51 and all of the retract valves 52, and all of the combined thermal relief and holding valves 53 are in the condition shown in FIG. 10.

Now assume that it is desired to extend all boom sections 11, 12, and 13 simultaneously. This is done by moving control lever 90 from neutral to the extend position thereby causing main valve 62 to move to the extend position and thereby closing the contacts of relay control switch 100. With main control valve 62 in the extend position, pressurized fluid is supplied through fluid line 83 to each of the extend ports 38 of the valve assemblies 41, 42, 43. Since closure of relay control switch 100 effects operation of relay 91 and energization of all six solenoid valves 51, 52, pressurized fluid is able to pass through each of the extend valves 51 and into the extend chambers 35 of each of the three cylinders 21, 22, 23. This results in extension of those cylinders and corresponding extension of the boom sections 11, 12, and 13. The boom sections continue to extend until control lever 90 and main valve 62 are returned to the neutral position and the relay 91 is de-energized by opening of relay control switch 100. As the cylinders 21, 22, 23 extend, fluid from the retract chamber 36 of cylinder 23 is expelled through line 86 into retract chamber 36 of cylinder 22 and fluid from the latter chamber is expelled through fluid line 85 into retract chamber 36 of cylinder 21. From retract chamber 36 of cylinder 21, fluid is expelled through passage 17, port 40, and through port 61 to the fluid line 84, through main control valve 62 to reservoir R.

With the cylinders 21, 22, 23 partly extended and the control system in neutral as shown in FIG. 10, the holding valves 53 and the check valves 63 prevent back flow of fluid from the extend chambers 35 of cylinders 21, 22, 23. Also, since main control valve 62 is closed, fluid back flow from the retract chambers 36 of the cylinders 21, 22, and 23 is prevented also.

To independently extend any one of the cylinders 21, 22, 23 and its associated boom section 11, 12, 13, the operator moves control lever 90 to the extend position and actuates one or more of the push-button switches 21A, 22A, 23A, depending on which of the boom sections he wishes to extend independently. Actuation of any one of the bush-button switches 21A, 22A, 23A prevents operation of control lever 90 from effecting energization of relay 91. Therefore, only the extend and retract solenoid valves 51 and 52, respectively, of the cylinder selected for operation are actuated. Assuming, for example, that the solenoid valves 65 and 72 of valve assembly 41 for cylinder 21 are actuated by push-button switch 23A while control lever 90 and main valve 62 are in the extend position. Then, only cylinder 21 and boom section 11 will extend. This results because opening of extended valve 51 and valve assembly 41 enables pressurized fluid from the source P to flow through line 83 and through the selected valve 51 and check valve 63 to extend chamber 35 of cylinder 21. The extend valves 51 and the valve assemblies 42 and 43 remain closed and the cylinders 22 and 23 do not operate even though the fluid lines 83, 81, and 82 are pressurized.

One or more of the cylinders 21, 22, 23 can be retracted individually by moving the control lever 90 to the retract position and actuating the appropriate push-button switch 21A, 22A, 23A.

As will be understood from the foregoing, all of the cylinders 21, 22, 23, and their associated boom sections 11, 12, and 13 may be retracted simultaneously by operation of the control lever 90 while not effecting actuation of any of the push-button switches 21A, 22A, 23A.

What is claimed is:

1. In a crane: a telescopic boom comprising movable boom sections and extendable and retractable hydraulic cylinders for moving said boom sections, each cylinder housing having an extend chamber and a retract chamber therein and an extend passage and a retract passage, respectively, communicating therewith through the piston rod of said cylinder, the retract chamber in one cylinder having a port connected by a flexible hose to the retract passage in another cylinder;

and control means for operating said cylinders and comprising:

a valve assembly mounted on each piston rod and comprising a solenoid valve connected to its associated extend passage and operable for controlling fluid flow in its associated cylinder;

a main control valve operable in one position to connect all the solenoid valves to a pressurized fluid source and to connect the retract passage in said one cylinder to a fluid reservoir, said main control valve being operable in another position to connect all the solenoid valves to said reservoir and to connect the retract passage in said one cylinder to said pressurized fluid source;

means including a relay switch and a relay, said switch being responsive to operation of said main control valve in either position for operating said relay for simultaneously controlling operation of all solenoid valves to thereby effect simultaneous movement of all said boom sections;

and a plurality of selector switches, each independently operable to control one of said solenoid valves and operable when said main control valve is operated simultaneously therewith in either position to effect operation of said relay switch to thereby prevent operation of the other of said solenoid valves by said relay in response to operation of said relay switch by said main control valve, and to thereby effect independent movement of its associated boom section.

2. A crane according to claim 1 wherein said main control valve has neutral, extend, and retract positions and wherein each valve assembly includes a holding valve to prevent fluid flow from its associated cylinder when said main control valve is in neutral position.

3. A crane according to claim 2 wherein each valve assembly further includes another solenoid valve for effecting release of said holding valve when said main control valve is in either extend or retract position, both solenoid valves in each valve assembly being normally closed valves and being electrically connected in parallel for simultaneous operation in response to said relay or in response to their associated selector switch.

4. In a crane:

a telescopic boom comprising movable boom sections;

extendable and retractable hydraulic cylinders for moving said boom sections, each cylinder comprising a housing having a piston therein dividing said housing into extend and retract chambers, and a piston rod connected to said piston and extending from said housing, said piston rod having an extend passage and retract passage therethrough communicating with said extend and retract chambers, respectively;

and control means for operating said hydraulic cylinders and comprising:

a valve assembly mounted on each piston rod and comprising a normally closed solenoid valve connected to the extend passage in the associated piston rod and operable for controlling fluid flow in its associated hydraulic cylinder, the retract chamber in one of said hydraulic cylinders being connected by a flexible hose to the retract passage of another of said hydraulic cylinders;

a main control valve having neutral, extend and retract positions and operable in said extend position to connect all solenoid valves to a pressurized fluid source and to connect the retract passage in said one hydraulic cylinder to a reservoir, said main control valve being operable in said retract position to connect all solenoid valves to said reservoir and to connect the retract passage in said one hydraulic cylinder to said pressurized fluid source;

means, including a relay and a relay switch for actuating said relay, responsive to operation of said main control valve to extend or retract position to operate said relay switch and said relay for simultaneously opening all solenoid valves to thereby effect simultaneous extend or retract, respectively, all of said boom sections;

and a plurality of selector switches, each independently operable to control one of said solenoid valves and operable when said main control valve is operated simultaneously therewith to effect operation of said relay switch to prevent operation of the other of said solenoid valves by said relay in response to operation of said main control valve, and to thereby effect independent movement of its associated boom section.

5. A crane according to claim 4 wherein each valve assembly includes a holding valve to prevent fluid flow from its associated cylinder when said main control valve is in neutral position.

6. A crane according to claim 5 wherein each valve assembly further includes another solenoid valve for effecting release of said holding valve when said main control valve is in either extend or retract position, both solenoid valves in each valve assembly being normally closed valves and being electrically connected in parallel for simultaneous operation in response to said relay or in response to their associated selector switch.

7. In a crane:

a telescopic boom comprising movable boom sections and extendable and retractable hydraulic cylinders for moving said boom sections, each cylinder housing having an extend chamber and a retract chamber therein and an extend passage and a retract passage, respectively, communicating therewith, the retract chamber in one cylinder having a port connected by a flexible hose to the retract passage in another cylinder;

and control means for operating said cylinders and comprising:

a valve assembly mounted on each piston rod and comprising a solenoid valve connected to its associated extend passage and operable for controlling fluid flow in its associated cylinder;

a main control valve operable in one position to connect all the solenoid valves to a pressurized fluid source and to connect the retract passage in said one cylinder to a fluid reservoir, said main control valve being operable in another position to connect all the solenoid valves to said reservoir and to connect the retract passage in said one cylinder to said pressurized fluid source;

relay means responsive to operation of said main control valve in either position for simultaneously controlling operation of all solenoid valves to thereby effect simultaneous movement of all said boom sections;

and a plurality of selector switches, each independently operable to control one of said solenoid valves and operable when said main control valve is operated simultaneously therewith in either position to effect operation of said relay means to thereby prevent operation of the other of said solenoid valves in response to operation of said main control valve, and to thereby effect independent movement of its associated boom section.

8. A crane according to claim 7 wherein said main control valve has neutral, extend, and retract positions and wherein each valve assembly includes a holding valve to prevent fluid flow from its associated cylinder when said main control valve is in neutral position.

9. A crane according to claim 8 wherein each valve assembly further includes another solenoid valve for effecting release of said holding valve when said main control valve is in either extend or retract position, both solenoid valves in each valve assembly being normally closed valves and being electrically connected in parallel for simultaneous operation in response to said relay means or in response to their associated selector switch.

* * * * *